US012514339B2

(12) United States Patent
Levine et al.

(10) Patent No.: US 12,514,339 B2
(45) Date of Patent: Jan. 6, 2026

(54) AIR BLADDER FOR SHOE

(71) Applicant: PRSSV LLC, Plainview, NY (US)

(72) Inventors: Tobias Levine, Plainview, NY (US); Nico Tramontana, Ocean City, NJ (US); Charlie Lepera, Halesite, NY (US)

(73) Assignee: PRSSV LLC, Plainview, NY (US)

( * ) Notice: Subject to any disclaimer, the term of this patent is extended or adjusted under 35 U.S.C. 154(b) by 0 days.

(21) Appl. No.: 18/550,032

(22) PCT Filed: Mar. 29, 2022

(86) PCT No.: PCT/US2022/022296

§ 371 (c)(1),
(2) Date: Sep. 11, 2023

(87) PCT Pub. No.: WO2022/212335

PCT Pub. Date: Oct. 6, 2022

(65) Prior Publication Data

US 2024/0148113 A1 May 9, 2024

Related U.S. Application Data

(60) Provisional application No. 63/167,157, filed on Mar. 29, 2021.

(51) Int. Cl.
*A43D 3/14* (2006.01)

(52) U.S. Cl.
CPC ..... *A43D 3/145* (2013.01)

(58) Field of Classification Search
USPC ..... 12/114.4
See application file for complete search history.

(56) References Cited

U.S. PATENT DOCUMENTS

| | | | | |
|---|---|---|---|---|
| 635,033 | A | 10/1899 | Bemis | |
| 1,271,547 | A | 7/1918 | Delaney | |
| 1,493,605 | A * | 5/1924 | Comstock | A43D 3/04 12/114.6 |
| 1,792,192 | A | 2/1931 | Sordelett | |
| 2,838,872 | A * | 6/1958 | Beck | A63H 3/06 472/102 |

(Continued)

FOREIGN PATENT DOCUMENTS

| | | | |
|---|---|---|---|
| GB | 629751 | A | 9/1949 |
| WO | 0182736 | A1 | 11/2001 |

*Primary Examiner* — Ted Kavanaugh
(74) *Attorney, Agent, or Firm* — Epstein Drangel LLP; Robert L. Epstein

(57) ABSTRACT

Exemplary embodiments of an air bladder are provided that is configured to retain the shape of a front toe portion of a shoe. For example, an air bladder for a shoe is provided, including a top portion, a bottom portion, a central body having a hollow interior configured to be inflated, the central body shaped to conform to a front toe portion of a shoe, a recess provided at a lower portion of the central body diving the central body, a middle portion having a bottom portion fluidly connected with the top portion of the central body narrower than the central body, and a top wing portion fluidly connected to the top of the middle portion that is wider than the middle portion. A shoe insert can also be provided to which the air bladder can be secured to.

8 Claims, 6 Drawing Sheets

(56) References Cited

U.S. PATENT DOCUMENTS

| | | | | |
|---|---|---|---|---|
| 3,372,495 | A * | 3/1968 | Finn | A43B 5/0407 36/117.6 |
| 4,144,658 | A * | 3/1979 | Swan, Jr. | A43B 19/00 36/117.6 |
| 5,444,926 | A * | 8/1995 | Allen | A43B 5/0405 36/29 |
| 2003/0046778 | A1 | 3/2003 | Sicurelli, Jr. | |
| 2012/0084999 | A1 | 4/2012 | Davis et al. | |
| 2012/0096654 | A1* | 4/2012 | Huebner | A43D 3/1408 12/115.4 |
| 2013/0055595 | A1 | 3/2013 | Brown | |
| 2020/0268111 | A1 | 8/2020 | Chang | |
| 2021/0120915 | A1* | 4/2021 | Panian | A43B 23/029 |

* cited by examiner

AIR BLADDER FOR SHOE

CROSS-REFERENCE TO RELATED APPLICATIONS

This application relates to and claims priority from U.S. Provisional Patent Application Ser. No. 63/167,157 filed Mar. 29, 2021, the entire disclosure of which is hereby incorporated herein by reference.

FIELD OF THE DISCLOSURE

The present disclosure relates to exemplary embodiments of an air bladder, and more particularly, to exemplary embodiments of an inflatable air bladder with a shoe insert.

BACKGROUND INFORMATION

Various shoe inserts are provided that are inserted within the shoe to retain the original shape of the shoe and prevent creases, particularly at the toe portion of a shoe. However, most shoe inserts have a specific size, and do not work for different sizes and shapes of shoes. Further, the shoe inserts are rigid so they do not conform to the real size of the interior of the shoe that they are placed within, particularly at the toe portion. Therefore, the shoe inserts are unable to retain the accurate shape of a shoe or prevent creases on the shoe.

SUMMARY OF EXEMPLARY EMBODIMENTS OF THE DISCLOSURE

Exemplary embodiments of the present disclosure can provide for an inflatable air bladder that is provided within the toe portion of a shoe to retain the shape of the toe portion of a shoe.

In some exemplary embodiments, an air bladder for a shoe can be provided, comprising a top portion, a bottom portion, a central body having a hollow interior configured to be inflated, the central body shaped to conform to a front toe portion of a shoe, a recess provided at a lower portion of the central body diving the central body, a middle portion having a bottom portion fluidly connected with the top portion of the central body narrower than the central body, and a top wing portion fluidly connected to the top of the middle portion that is wider than the middle portion.

In some exemplary embodiments, the top wing portion comprises a top left wing and a top right wing that are fluidly connected to the middle portion and the central body. In some exemplary embodiments, the air bladder further comprises a first recess provided between the central body and the top left wing, and a second recess provided between the central body and the top right wing, wherein the middle portion of the air bladder is provided between the first and second recesses. In some exemplary embodiments, the air bladder further comprises a recess provided at a top portion of the top wing portion between the top left wing and the top right wing.

In some exemplary embodiments, the air bladder further comprises an air valve configured to allow air into the air bladder and out of the air bladder. In some exemplary embodiments, the central body, middle portion and top wing portion are configured to be expanded when air is provided into the air bladder through the air valve. In some exemplary embodiments, the air valve is provided at the bottom portion of the top wing portion.

In some exemplary embodiments, the air bladder further comprises engagement portions at the bottom portion of the air bladder configured to engage the air bladder to a shoe insert. In some exemplary embodiments, the engagement portions are provided at a bottom of the central body and top wing portion. In some exemplary embodiments, the engagement portions comprise buttons.

In some exemplary embodiments, an apparatus for retaining a shape of a front toe portion of a shoe is provided, comprising a shoe insert having a convex shape conforming to a shape of a front toe portion of a shoe, the shoe insert configured to be inserted into the front toe portion of a shoe, an air bladder provided on top of the shoe insert having an inflatable body configured to expand and contract, an air valve on the air bladder configured to allow air into the air bladder to expand the inflatable body of the air bladder, and allow air out of the air bladder to contract the inflatable body of the air bladder.

In some exemplary embodiments, the apparatus further comprises an air pump configured to provide air into the air valve. In some exemplary embodiments, the apparatus further comprises an air tube having a first end connected to the air valve and a second end connected to the air pump, the air tube configured to provide air from the air pump into the air valve. In some exemplary embodiments, the apparatus further comprises a top portion, a bottom portion. a central body shaped to conform to a front toe portion of a shoe, a top wing portion, and a middle portion provided between the central body and the top wing portion, the middle portion having a narrower width than the central body and the top wing portion, wherein the central body, middle portion and top wing portion have a hollow interior and are fluidly connected to each other. In some exemplary embodiments, the apparatus further comprises a recess provided inward into the central body at a lower portion of the central body opposite the middle portion. In some exemplary embodiments, the top wing portion comprises a top left wing and a top right wing that are fluidly connected to the middle portion and the central body.

In some exemplary embodiments, the apparatus further comprises a first recess provided between the central body and the top left wing, and a second recess provided between the central body and the top right wing, wherein the middle portion of the air bladder is provided between the first and second recesses. In some exemplary embodiments, the apparatus further comprises engagement portions at the bottom portion of the air bladder configured to engage with corresponding engagement portions at a top portion of the shoe insert. In some exemplary embodiments, the engagement portions of the air bladder are provided at a bottom of the central body and top wing portion. In some exemplary embodiments, the engagement portions comprise buttons.

BRIEF DESCRIPTION OF THE DRAWINGS

The foregoing and other objects of the present disclosure will be apparent upon consideration of the following detailed description, taken in conjunction with the accompanying drawings, and claims, in which like reference characters refer to like parts throughout, and in which:

Figure 1:
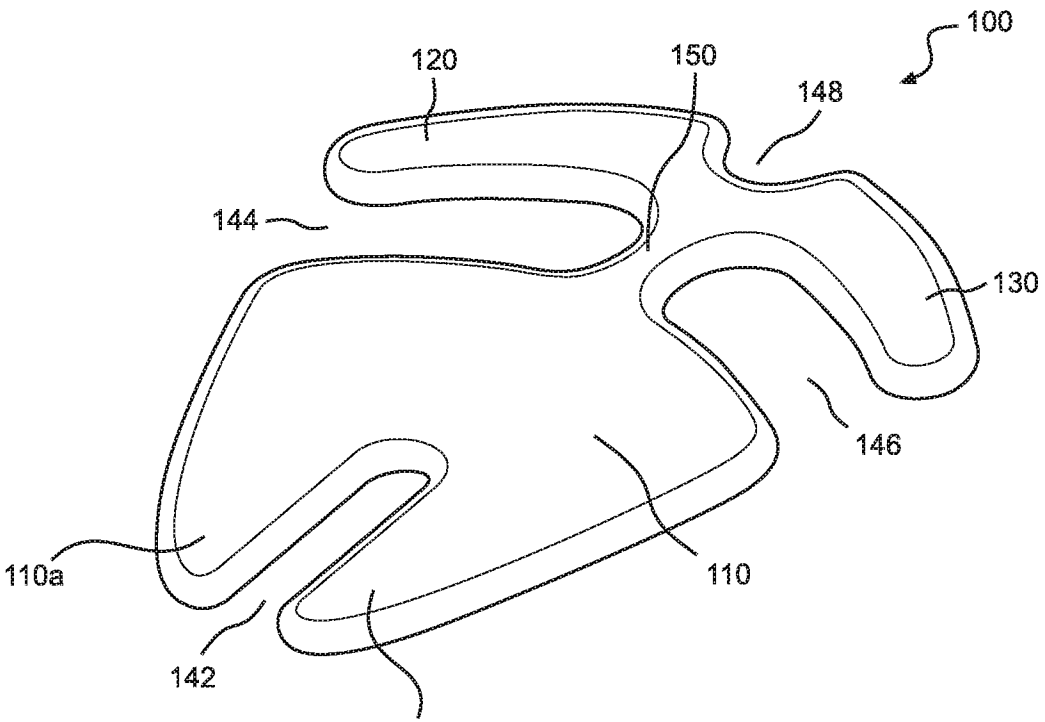
FIG. 1 illustrates a top perspective view of an air bladder according to an exemplary embodiment of the present disclosure.

Throughout the figures, the same reference numerals and characters, unless otherwise stated, are used to denote like features, elements, components or portions of the illustrated embodiments. Moreover, while the subject disclosure will now be described in detail with reference to the figures, it is done so in connection with the illustrative embodiments. It is intended that changes and modifications can be made to the described embodiments without departing from the true scope and spirit of the subject disclosure.

DETAILED DESCRIPTION OF EXEMPLARY EMBODIMENTS OF DISCLOSURE

The exemplary embodiments of the present disclosure can provide for a shoe insert having an inflatable air bladder. The air bladder can be provided on a top portion of the shoe insert and air is provided into the air bladder which conforms to a shape of an interior front portion of a shoe to prevent creases.

Exemplary embodiments of the various methods and apparatuses will now be described with reference to the figures. The following description of the various embodiments is merely exemplary in nature and is in no way intended to limit the scope of the disclosure, its application, or uses.

FIG. 1 illustrates a top perspective view of an air bladder 100 according to an exemplary embodiment of the present disclosure. The air bladder 100 can have a lower central body 110, a middle portion 150, a top left wing 120 and a top right wing 130. The central body 110, middle portion 150, top left wing 120 and top right wing 130 can have a hollow interior that can be expanded, as will be explained below. The interiors of the central body 110, top left wing 120 and top right wing 130 are fluidly connected through middle portion 150. The middle portion can be narrow compared to central body 110 at the portion it connects the central body 110 to the top left wing 120 and top right wing 130.

A recess 142 can be provided at a bottom portion of lower central body 110 that separates the central body 110 into left side 110*a* and right side 110*b* at a frontmost portion where the air bladder 110 would be located at a front portion of a shoe. Left side 110*a* can engage with a front side portion of a shoe and right side 110*a* can engage with an opposing front side portion of a shoe. Recess 144 can be provided between central body 110 and top left wing 120. Recess 146 can be provided between central body 110 and top right wing 130. Recesses 144 and 146 provide a gap between central body 110 and top left wing 120 and top right wing 130, respectively. A recess 148 can also be provided at a top of the air bladder 100 between top left wing 120 and top right wing 130. These recesses can have a curved shape and can aid in forming a shape of an air bladder 100 that can prevent creases in portions of a shoe where creases are likely to form (e.g., the front top portion and front side portions of a shoe). The air bladder 100 can be made of various materials, such as but not limited to plastic or rubber. In some exemplary embodiments, the air bladder 100 can be made of thermoplastic polyurethane.

Figure 2A:
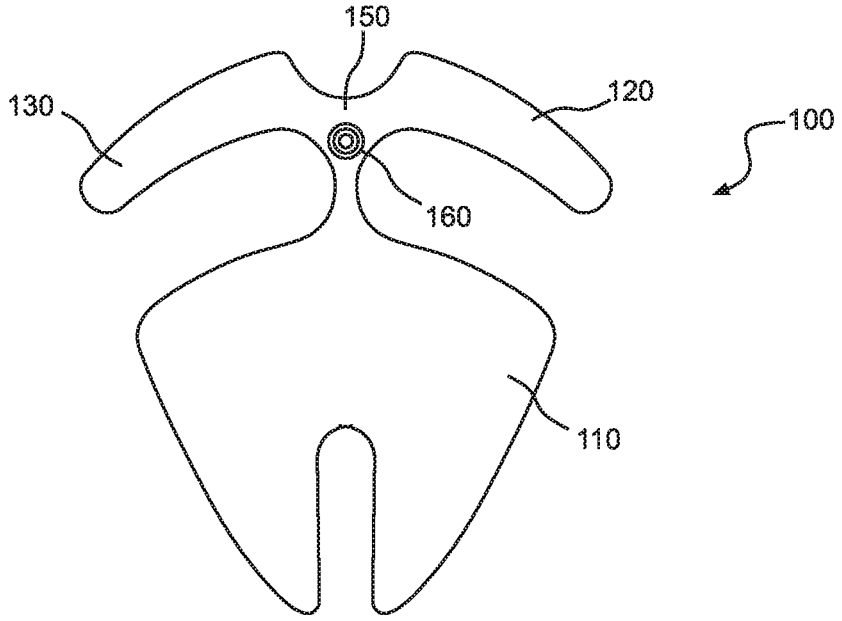
FIGS. 2A and 2B illustrate a bottom and side view, respectively, of an air bladder according to an exemplary embodiment of the present disclosure.
Figure 2B:
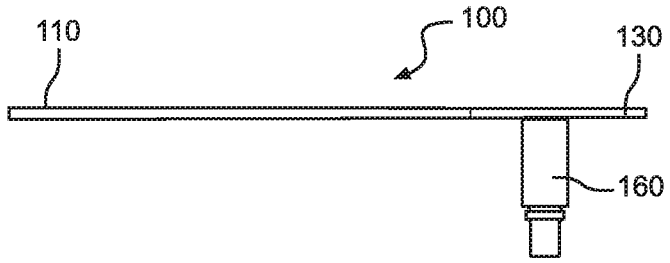

FIGS. 2A and 2B illustrate a bottom and side view, respectively, of an air bladder 100 according to an exemplary embodiment of the present disclosure. The air bladder 100 can have an air valve 160 that connects to the interior of the air bladder 100. For example, the air valve 160 can connect to the middle portion 150 of the air bladder 100 and can be used to pump air into the air bladder 100 to expand the air bladder 100 and release air from the air bladder 100 to contract the air bladder 100. In some exemplary embodiments, once air is pumped into the air bladder 100 and removed, the air valve 160 can have an automatic stop to prevent air from exiting the air bladder 100. In some exemplary embodiments, a luer valve can be used. In some exemplary embodiments, the air valve 160 can be made of thermoplastic polyurethane.

Figure 3:
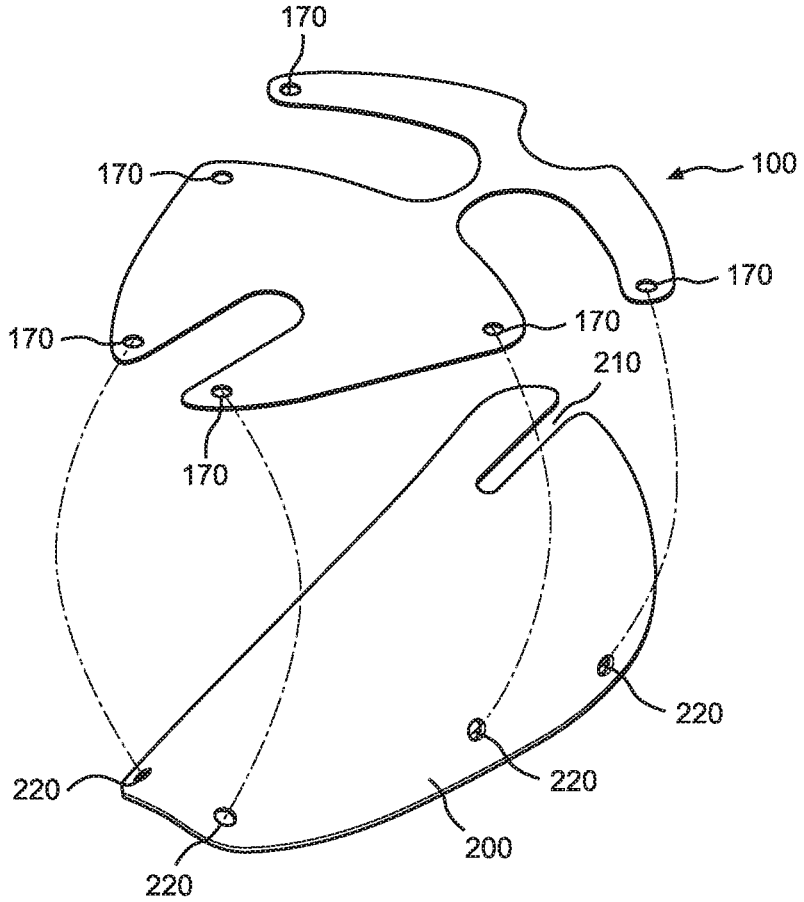
FIG. 3 illustrates an air bladder provided on a shoe insert according to an exemplary embodiment of the present disclosure.

FIG. 3 illustrates an air bladder 100 provided on a shoe insert 200 according to an exemplary embodiment of the present disclosure. The shoe insert 200 can be sized and shaped to conform to an interior front upper portion of a shoe. The shoe insert 200 can be made of a rigid material so it keeps its shape, such as but not limited to a hard plastic like polypropylene. The shoe insert 200 can have a convex shape such that the area is hollow between the sides of the shoe insert 200. The shoe insert 200 can be thin so it can be lightweight and easily insertable into a shoe. The shoe insert 200 can have a recess 210 at an upper portion thereof, which corresponds to the location of the air valve 160 of the air bladder 100. The air bladder 100 can have engagement portions 170 that connect to engagement portions 220 (e.g., holes 220) of the shoe insert 200. The engagement portions 170 can be provided on a bottom portion of the air bladder 100 to engage with a top portion of the shoe insert 200. Any type of engagement can be used, engagement portions 170 are not limited to any type of connection. For example, adhesives, tapes, or hook and loop fasteners or any type of mechanical connection can be used for connecting the air bladder 100 to the shoe insert 200.

In some exemplary embodiments, buttons 170 (e.g. snap buttons) can be provided on a bottom portion of an air bladder 100 that snap into holes 220 on the shoe insert 200 to secure the air bladder 100 on the shoe insert 200. The buttons 170 can snap out of the holes 220 if a user wants to remove the air bladder 100 from the shoe insert 200. For example, studs on the bottom portion of the air bladder 100 can engage with sockets or holes provided on the shoe insert. Various numbers of buttons 170 on the air bladder 100 and holes 220 on the shoe insert can be provided, and buttons 170 and holes 220 are not limited to any type or number. The locations and size of the buttons 170 can correspond to the locations and sizes of the holes 220 on the shoe insert 200 to secure the air bladder 100 on the shoe insert 200.

Figure 4A:
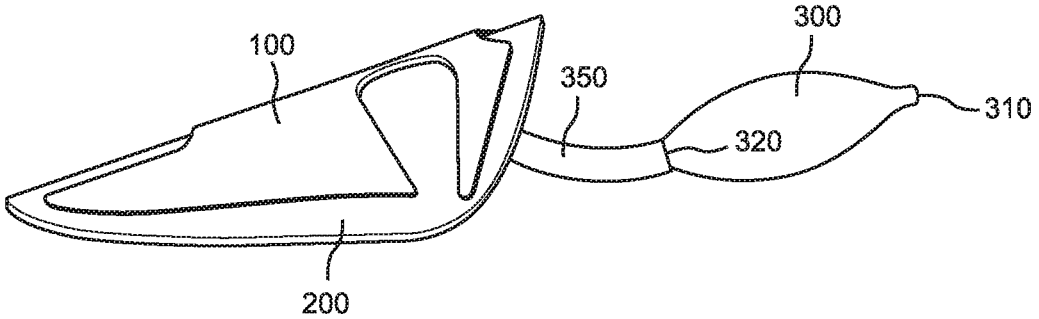
FIGS. 4A and 4B illustrate a side and top view, respectively, of an air bladder on a shoe insert connected to an air pump according to an exemplary embodiment of the present disclosure.
Figure 4B:
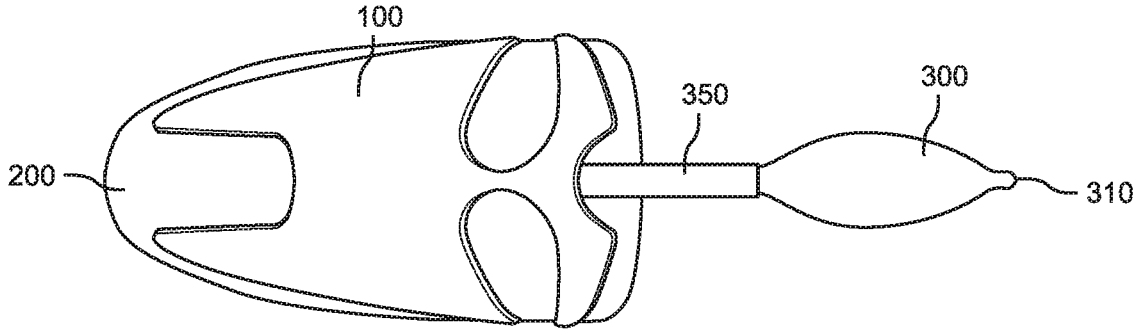

FIGS. 4A and 4B illustrate a side and top view, respectively, of an air bladder 100 on a shoe insert 200 connected to an air pump 300 according to an exemplary embodiment of the present disclosure. An air pump 300 can be used to pump air into the air bladder 100. An orifice 310 at a first end of the air pump 300 allows air to enter pump 300. A tube 350 is connected to the air pump 300 at a second end 320 of the air pump 300. The tube 350 can be connected to the air valve 160 of the air bladder 100. The air pump 300 can be squeezed to deliver air from the air pump 300, into the tube 350, and into the air bladder 100. The air valve 160 prevents the air from coming back into the tube (350). After the air bladder 100 is inflated to the appropriate amount of volume, the tube 350 can be disconnected from the air valve 160 or tube 350 can be left in place and kept within the shoe as is shown below.

Figure 5:
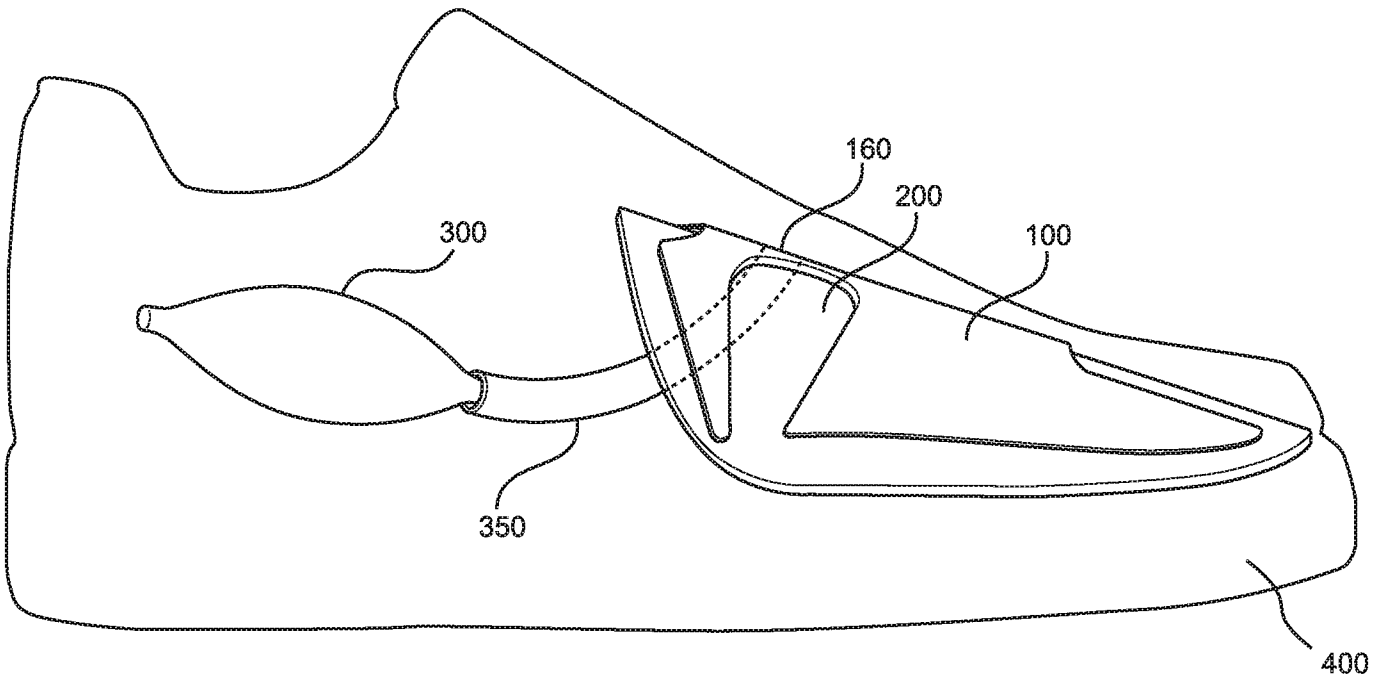
FIG. 5 illustrates a shoe insert with an air bladder in a shoe according to an exemplary embodiment of the present disclosure.

FIG. 5 illustrates a shoe insert 200 with an air bladder 100 in a shoe 400 according to an exemplary embodiment of the present disclosure. The air bladder 100 can be secured to the shoe insert 200, and the shoe insert 200 can then be inserted into the shoe 400. In some exemplary embodiments, the pump 300 and tube 350 can be connected to the air bladder 100 before inserting the shoe insert 200 into the shoe or can be connected after. The shoe insert 200 is rigid and can have a shape that conforms to a front interior portion of a shoe 400. The pump 300 can then be squeezed to deliver air into the air bladder 100, which provides air into the interiors of the lower central body 110, middle portion 150, top left wing 120 and top right wing 130 of the air bladder 100. The central body 110 can prevent creases on the front portion of the shoe 400, and the top left wing 120 and top right wing 130 can prevent creases that can form on the front side portions of the shoe 400. Once the shoe 400 appears to have a snug fit with the shoe insert 200 and air bladder 100, the user can stop pumping air with pump 300. The user can also press a release in the air valve 160 to release air from the air bladder 100 if too much air is pumped into the air bladder 100. The pump 300 and tube 350 can be removed or left in place within the shoe 400.

Figure 6A:
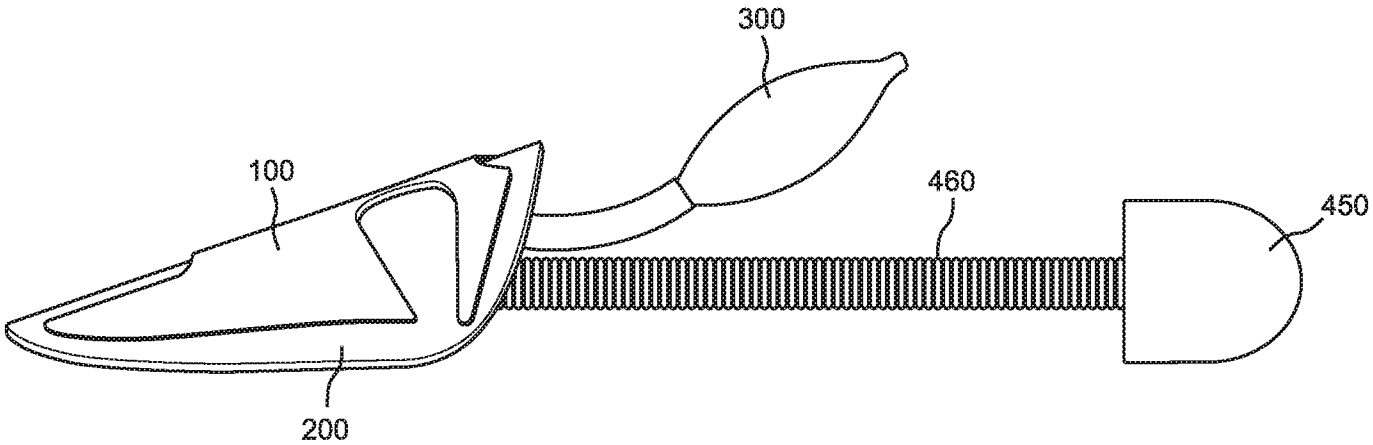
FIGS. 6A and 6B illustrate a side and bottom view, respectively, of an alternative embodiment of a shoe insert with an air bladder according to an exemplary embodiment of the present disclosure.
Figure 6B:
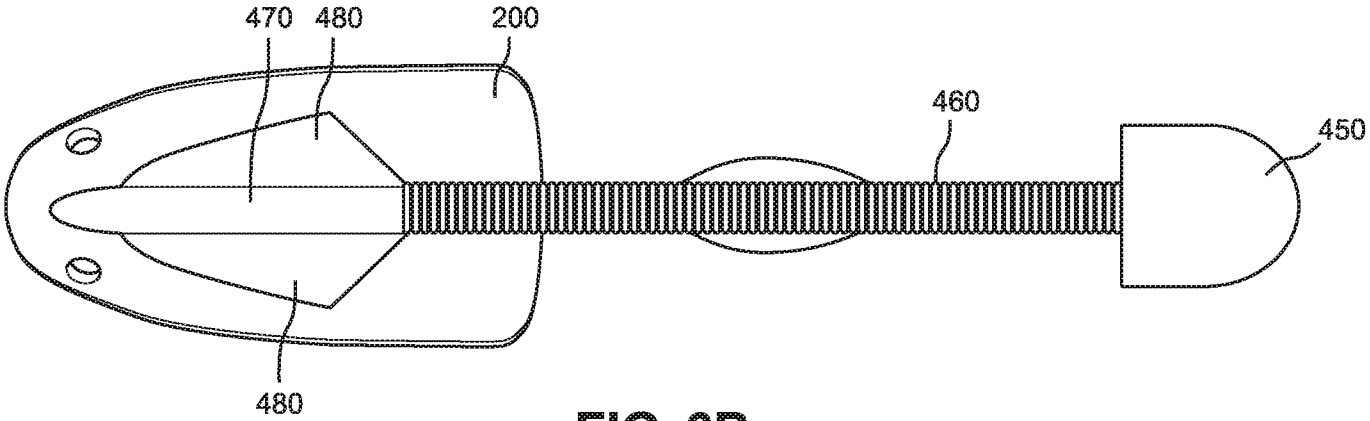

FIGS. 6A and 6B illustrate a side and bottom view, respectively, of an alternative embodiment of a shoe insert according to an exemplary embodiment of the present disclosure. The bottom portion of the shoe insert 200 can have plates 480 secured to the shoe insert 200, that have a hollow circular interior 470 between the plates. A flexible tension rod 460 can be connected to the hollow circular interior 470 at a first end, and to an end base 450 at a second end. The end base 450 can be inserted into and held in place at a rear of a shoe. The flexible tension rod 460 presses the shoe insert 200 into the front portion of the shoe and the end base 450 into the rear of the shoe to hold the shoe insert 200 and air bladder in place inside the shoe.

Various other considerations can also be addressed in the exemplary applications described according to the exemplary embodiments of the present disclosure. For example, various materials may be used to construct the elements described in the figures. Various sizes of the elements can also be provided for various sizes of shoes. For example, different size shoe inserts and air bladders can be provided for children's and adult size shoes.

Various advantages can also be provided by the exemplary embodiments of the present disclosure. The top wings and recesses of the air bladder allow air fill inside the front of the shoe as well as air fill in the sides of the shoe which are areas of crease and wear. These shapes allow the air bladder to move freely inside the shoe and find area needing air fill to smooth out the creases. When filling the air bladder with air, the resistance of the air bladder pushes against the shoe insert and creates a lock to push and smooth the creases in the front and sides of the shoe. The air bladder and shoe insert can be used on various footwear, such as but not limited to sneakers, dress shoes, casual shoes and boots.

The foregoing merely illustrates the principles of the disclosure. Various modifications and alterations to the described embodiments will be apparent to those skilled in the art in view of the teachings herein. It will thus be appreciated that those skilled in the art will be able to devise numerous systems, arrangements, manufacture and methods which, although not explicitly shown or described herein, embody the principles of the disclosure and are thus within the spirit and scope of the disclosure.

What is claimed is:

1. An air bladder having a hollow interior configured to be inflated, in combination with a rigid insert comprising an exterior surface, said air bladder being situated over and supported by said exterior surface of said rigid insert, said air bladder and rigid insert combination being removably received in a shoe to retain the shape of the front portion of the shoe when the shoe is not in use, wherein said air bladder further comprises a body and curved wings fluidly connected to said body and extending from said body in substantially opposite directions, at least one of said wings having an edge spaced from said body to define a recess therebetween.

2. The combination of claim 1 wherein said air bladder and insert are received in the front portion of the shoe.

3. The combination of claim 1 wherein in said air bladder has a front portion comprising a recess defined by substantially parallel sides dividing said front portion of said air blader.

4. The combination of claim 3 wherein said recess comprises an open end and said sides of said recess terminate within said front portion of said air bladder.

5. The combination of claim 1 wherein said air bladder is connected to said rigid insert.

6. The combination of claim 1 wherein said air bladder further comprises a body with an exterior side including an outwardly extending portion connected to an inwardly extending portion.

7. The combination of claim 1 wherein said rigid insert defines a curved interior space.

8. The combination of claim 1 wherein said exterior surface of said rigid insert is convex.

* * * * *